US010058196B2

(12) United States Patent
Goppion

(10) Patent No.: US 10,058,196 B2
(45) Date of Patent: Aug. 28, 2018

(54) SHOWCASE WITH ROTOTRANSLATORY OPENING

(71) Applicant: GOPPION S.P.A., Trezzano sul Naviglio (IT)

(72) Inventor: Alessandro Goppion, Milan (IT)

(73) Assignee: GOPPION S.P.A., Trezzano sul Naviglio (MI) (IT)

( * ) Notice: Subject to any disclaimer, the term of this patent is extended or adjusted under 35 U.S.C. 154(b) by 0 days.

(21) Appl. No.: 14/790,829

(22) Filed: Jul. 2, 2015

(65) Prior Publication Data

US 2016/0000237 A1 Jan. 7, 2016

(30) Foreign Application Priority Data

Jul. 2, 2014 (IT) ..... MI2014A1205

(51) Int. Cl.
*A47F 3/00* (2006.01)
*A47F 3/14* (2006.01)
*E05D 15/32* (2006.01)

(52) U.S. Cl.
CPC ..... *A47F 3/145* (2013.01); *A47F 3/005* (2013.01); *E05D 15/32* (2013.01); *E05Y 2900/202* (2013.01)

(58) Field of Classification Search
CPC ..... A47F 3/145; A47F 3/005; A47F 3/007; A47F 2003/008; A47F 3/0434;
(Continued)

(56) References Cited

U.S. PATENT DOCUMENTS 712,797 A * 11/1902 Holtzmann ..... E05D 3/14 16/370
1,380,222 A 5/1921 Lichtenberg
(Continued)

FOREIGN PATENT DOCUMENTS

DE 4110942 A1 10/1991
DE 19739394 A1 3/1999
(Continued)

OTHER PUBLICATIONS

Italian Search Report completed on Feb. 10, 2015 for Italian Application MI20141205 filed on Jul. 2, 2014 in the name of Goppion S.P.A.
(Continued)

*Primary Examiner* — Hiwot E Tefera
(74) *Attorney, Agent, or Firm* — Steinfl + Bruno, LLP

(57) ABSTRACT

A showcase for preservation and display of objects. The showcase has a fixed casing and at least one openable panel made of glass, mounted through opening supports on the fixed casing, openable externally towards a first side of the showcase. The opening supports have an upper asymmetric quadrilateral and a lower asymmetric quadrilateral having the same geometry, respectively comprising a short upper rod and a long upper rod and a short lower rod and a long lower rod; the lengths of the short rods are equal to each other, as well as the lengths of the long rods are equal to each other. The opening takes place in a single roto-translation step. The asymmetric quadrilateral system formed by the uneven rods determines a roto-translational movement of the openable panel towards the first side of the showcase, so that the openable panel leaves the opening space completely free.

8 Claims, 8 Drawing Sheets

(58) Field of Classification Search
CPC ..... A47F 3/004; A47F 3/00; Y10T 16/547; Y10T 16/5476; E05D 15/32; E05D 3/14; E05D 3/02; E05D 15/46; E05D 15/56; E05D 15/58; E05Y 2900/202; E05Y 2900/204; E05Y 2900/20
USPC ..... 312/138.1, 114, 139.1, 102
See application file for complete search history.

(56) References Cited

U.S. PATENT DOCUMENTS

| | | | | | |
|---|---|---|---|---|---|
| 1,407,740 | A * | 2/1922 | Evans, Jr. | E05D 3/14 16/370 | |
| 2,023,260 | A | 12/1935 | Beers et al. | | |
| 2,570,479 | A * | 10/1951 | Pollman | E05D 3/14 16/370 | |
| 2,901,766 | A * | 9/1959 | Marquis | E05D 3/147 16/370 | |
| 3,341,267 | A | 9/1967 | Weitzman | | |
| 3,998,509 | A | 12/1976 | Hauser | | |
| 4,660,903 | A | 4/1987 | Shinagawa | | |
| 5,120,116 | A | 6/1992 | Amstutz et al. | | |
| 5,524,977 | A | 7/1996 | Orawski | | |
| 6,398,322 | B1 | 6/2002 | Chaplin | | |
| 6,758,539 | B2 | 7/2004 | Cianetti | | |
| 7,780,249 | B2 | 8/2010 | Cianetti | | |
| 9,532,664 | B2 | 1/2017 | Goppion | | |
| 9,700,154 | B2 | 7/2017 | Goppion | | |
| 2006/0028102 | A1 | 2/2006 | Hahn | | |
| 2008/0290765 | A1* | 11/2008 | Hahn | A47F 3/005 312/139.1 | |
| 2015/0022066 | A1 | 1/2015 | Dimitrakos | | |
| 2015/0130334 | A1 | 5/2015 | Goppion | | |
| 2015/0259960 | A1* | 9/2015 | Smith | E05D 3/147 16/250 | |
| 2016/0312521 | A1* | 10/2016 | Berger | E06B 3/4672 | |

FOREIGN PATENT DOCUMENTS

| | | | | | |
|---|---|---|---|---|---|
| DE | 10341934 | A1 | | 5/2005 | |
| DE | 202006017556 | | | 2/2007 | |
| EP | 1854953 | | | 11/2007 | |
| EP | 1983132 | A2 | * | 10/2008 | E05D 15/32 |
| GB | 1959 | A | | 7/1911 | |
| GB | 726873 | A | | 3/1955 | |
| GB | 2245155 | A | | 1/1992 | |
| JP | 2980602 | B1 | * | 11/1999 | E05D 15/32 |
| JP | 2000160921 | | | 11/1999 | |
| WO | 2006070428 | A1 | | 7/2006 | |

OTHER PUBLICATIONS

Italian Written Opinion completed on Feb. 10, 2015 for Italian Application MI20141205 filed on Jul. 2, 2014 in the name of Goppion S.P.A.
Italian Search Report for MI2014A001206 filed Jul. 2, 2014 in the name of Goppion S.p.A. Completion Date: Feb. 20, 2015. 2 pages.
Italian Written Opinion for MI2014A001206 filed Jul. 2, 2014 in the name of Goppion S.p.A. Completion Date: Feb. 20, 2015. 5 pages.
Italian Search Report for MI2014A1391 filed Jul. 31, 2014 in the name of Goppion S.p.A. Completion Date: Mar. 19, 2015. 2 pages.
Italian Written Opinion for MI2014A1391 filed Jul. 31, 2014 in the name of Goppion S.p.A. Completion Date: Mar. 19, 2015. 5 pages.
Non-Final Office Action for U.S. Appl. No. 14/790,766, filed Jul. 2, 2015 on behalf of Alessandro Goppion, dated Sep. 8, 2016. 9 pages.
Non-Final Office Action for U.S. Appl. No. 14/811,753, filed Jul. 28, 2015 on behalf of Alessandro Goppion, dated Feb. 9, 2016. 9 pages.
Notice of Allowance for U.S. Appl. No. 14/811,753, filed Jul. 28, 2015 on behalf of Alessandro Goppion, dated Aug. 31, 2016. 6 pages.

* cited by examiner

SHOWCASE WITH ROTOTRANSLATORY OPENING

CROSS REFERENCE TO RELATED APPLICATIONS

The present application claims priority to Italian application M12014A001205 filed on Jul. 2, 2014 which is incorporated herein by reference in its entirety.

FIELD

The present invention refers to a showcase for preservation and display of objects in a protected environment, such as typically works of art, objects of cultural heritage or in any case delicate objects, in museums, exhibitions and the like.

Here and hereafter, protected environment means an environment in which the atmosphere is controlled, through monitoring of one or more parameters from temperature, humidity, dust content, pollutant content, in order to maintain the foreseen storage conditions of the objects on display, and in which unauthorised people are prevented from being able to gain access to them, in order to avoid theft or damage to the objects on display.

BACKGROUND

Showcases of this type must therefore satisfy various kinds of requirements, in relation to the storage and integrity of the objects displayed. Moreover, of course, these showcases must ensure maximum visibility of the objects displayed.

In order to improve visibility, manufacturers of showcases try as hard as they can to use transparent materials—typically glass—for the walls of the showcase. As well as ensuring maximum visibility of the objects displayed, the extensive use of glass is often desired by designers of showcases because the transparency of the material allows the objects displayed to be given maximum visual impact.

Therefore, showcases have been developed having a base block with a case formed by panels on top; the base block houses all of the technical components necessary to ensure that the environment inside the case is protected and is thus normally closed by non-transparent walls, which hide all of the technical components from view; vice-versa, the walls of the case are made entirely or partially from glass, for the aforementioned reasons.

The possibility of access to the inside of the case, for the housing, removal or maintenance of the objects displayed, is normally obtained by providing for at least one of the side panels to be openable. For this purpose, opening supports of various kinds are used, which allow opening by rotation or roto-translation of the panel (more or less complex hinges) or by sliding (sliding guides). These opening supports must clearly ensure the correct closure of the openable panel, but must also allow an opening that is as wide as possible, so as to make access possible and easy also to arrange very large-sized objects (relative to the size of the showcase), possibly also in cases in which the weight of the object forces the uses of a fork lift or similar to move the object.

Therefore, there is a problem of maximising the degree of opening of the openable panel, even in the presence of panels made of transparent material.

SUMMARY

Consequently, the present invention concerns a showcase as defined in claim 1. Preferred characteristics are indicated in the dependent claims.

In particular, the invention concerns a showcase for preservation and display of objects, comprising a fixed casing and at least one openable panel made of glass, mounted through opening supports on the fixed casing so as to be openable externally towards a first side of the showcase, characterised in that:

the opening supports comprise an upper asymmetric quadrilateral and a lower asymmetric quadrilateral having the same geometry, respectively comprising a short upper rod and a long upper rod and a short lower rod and a long lower rod, in which the lengths of the two short rods are equal to each other, as well as the lengths of the two long rods are equal to each other;

the short rods are pivoted to the fixed casing at respective first upper and lower aligned short rod pins and the long rods are pivoted to the fixed casing at respective first upper and lower aligned long rod pins;

the short rods are pivoted to the openable panel at respective second upper and lower aligned short rod pins and the long rods are pivoted to the openable panel at respective second upper and lower aligned long rod pins.

With this structure, the opening of the openable panel takes place in a single roto-translation step. The asymmetric quadrilateral system formed by the uneven rods determines a roto-translational movement of the openable panel, towards the first side of the showcase, so that the openable panel leaves the opening space completely free.

The positions of the rod pins and the lengths of the rods determine the geometry of the linkage.

Preferably, with the showcase closed the second short rod pins are closer to the first side of the showcase with respect to the second long rod pins.

Preferably, the first short rod pins are closer to the first side of the showcase with respect to the first long rod pins.

Preferably, with the showcase closed the first short rod pins are closer to the openable panel with respect to the first long rod pins.

The aforementioned configurations make it possible to make movements suitable for the opening requirements of a showcase, ensuring minimal bulks during maneuvering and complete opening of the opening space.

In a preferred embodiment, the short rods and/or the long rods are arc-shaped. This allows the bulk of the rods themselves to be limited in front of the opening space with the showcase open, and also allows the first side of the showcase to be avoided better with the roto-translational movement.

Alternatively, in another preferred embodiment, the short rods and/or the long rods are straight-shaped.

In a preferred embodiment, the short rods and the long rods are sized so as to bear the weight of the openable panel in a distributed manner, distributed in a more or less balanced manner between the rods. This makes it possible to have rods with similar or the same section.

Alternatively, in another preferred embodiment, the long rods are sized so as to bear the weight of the openable panel, whereas the short rods are sized so as to only guide the opening and closing movements of the openable panel. This obliges long rods with a relatively large section, but allows the static equilibrium to be controlled better, entrusted only to the long rods.

In a preferred embodiment, the long rods have a variable length. This makes it possible to adjust the length of the rods and thus to introduce variations in the geometry of the quadrilaterals, variations that are useful in the step of installation and preparation of the showcase; moreover, this characteristic can be used to widen the opening of the showcase.

BRIEF DESCRIPTION OF THE DRAWINGS

Further characteristics and advantages of a showcase according to the invention will become clearer from the following description of some preferred embodiments thereof, made with reference to the attached drawings. In such drawings.

DETAILED DESCRIPTION

Figure 1:
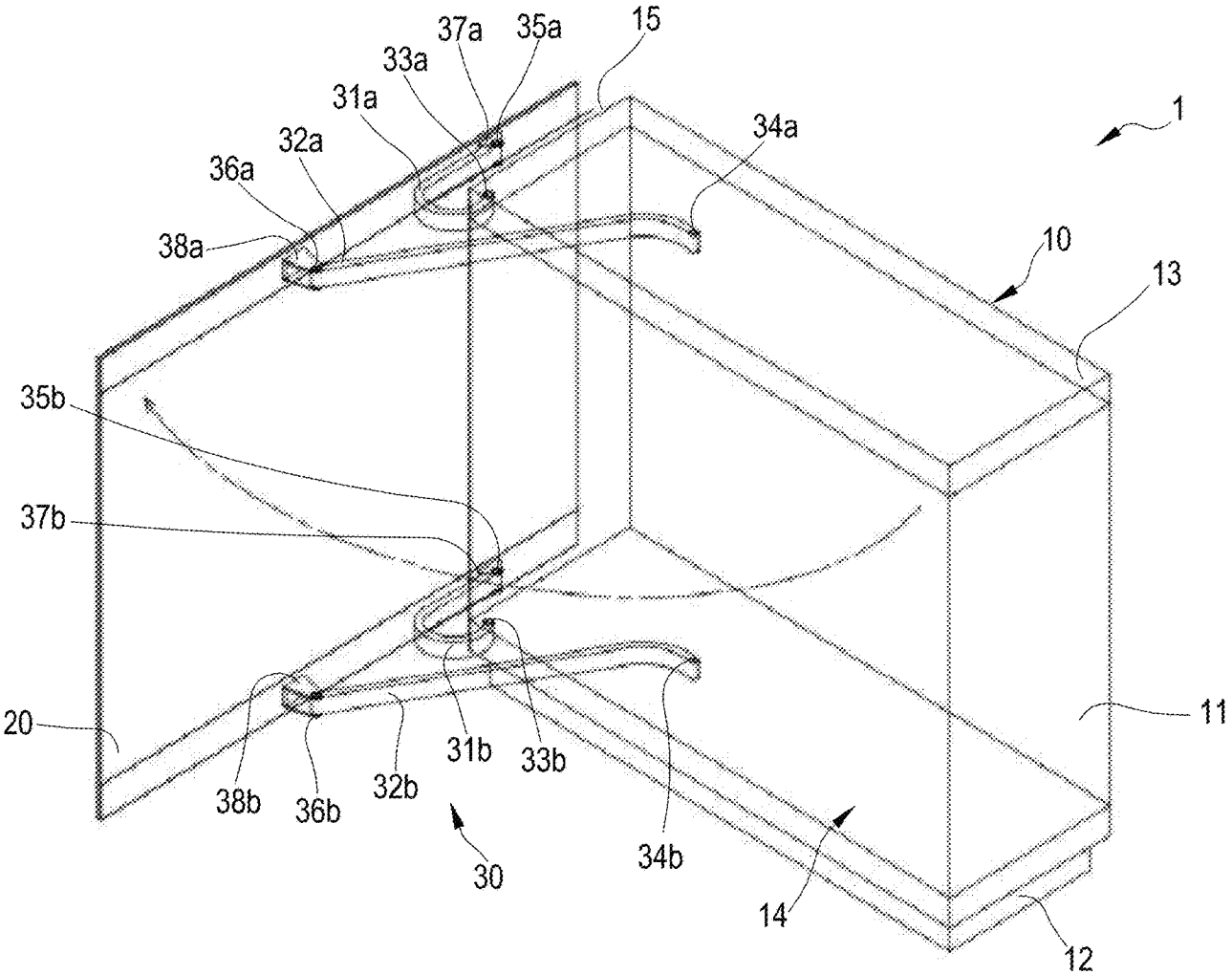
FIG. 1 is a schematic perspective view of a showcase according to a first embodiment of the invention, with openable panel in open position.

The figures show a showcase 1 according to the invention, suitable for the preservation and display of objects. The showcase 1 comprises a fixed casing 10, with fixed side panels 11, a base block 12 and a top panel 13, mounted fixedly connected to each other around an opening space 14; in the base block 12 and/or in the top panel 13 possible apparatuses (per se known and not illustrated here) are housed for controlling the showcase 1, for example for controlling its illumination, security, climate-control. Of the side panels 11, in the figures reference numeral 15 indicates the one facing towards a first side of the showcase 1, adjacent to the opening space 14. The showcase 1 also comprises at least one openable panel 20, typically made of glass, mounted in a sealed manner on the fixed casing 10 at the opening space 14, through opening supports 30. The seal between the openable panel 20 and the casing 10 is ensured by gaskets, selected according to the sealing requirements of the specific showcase, not highlighted in the figures and per se known.

The opening supports 30 comprise an upper asymmetric quadrilateral, with a short rod 31*a* and a long rod 32*a*, and a lower asymmetric quadrilateral, with a short rod 31*b* and a long rod 32*b*; the rods are also wholly indicated as short rods 31 and long rods 32 or as rods 31, 32. The two upper and lower quadrilaterals have the same geometry, so as to produce the same movement.

The lengths of the two short rods 31 are the same as each other, as well as the lengths of the two long rods 32 are the same as each other; preferably, the two short rods 31 are the same as each other, as well as the two long rods 32 are the same as each other.

The short rods 31 are pivoted to the fixed casing 10 at respective first upper 33*a* and lower 33*b* aligned short rod pins and the long rods 33 are pivoted to the fixed casing 10 at respective first upper 34*a* and lower 34*b* aligned long rod pins. Moreover, the short rods 31 are pivoted to the openable panel 20 at respective second upper 35*a* and lower 35*b* aligned short rod pins and the long rods 33 are pivoted to the openable panel 20 at respective second upper 36*a* and lower 36*b* aligned long rod pins. The rod pins are also wholly indicated as first short rod pins 33, second short rod pins 35, first long rod pins 34, second long rod pins 36.

The positions of the rod pins 33-36 and the lengths of the rods 31, 32 determine the geometry of the linkage.

In the showcase 1, with the showcase closed the second short rod pins 35 are closer to the first side 15 of the showcase 1 with respect to the second long rod pins 36. Moreover, the first short rod pins 33 are closer to the first side 15 of the showcase 1 with respect to the first long rod pins 34. Furthermore, with the showcase closed the first short rod pins 33 are closer to the openable panel 20 with respect to the first long rod pins 34.

In the showcase 1, the short rods 31 and the long rods 32 are arc-shaped, so as to limit the bulk of the rods themselves in front of the opening space 14 with the showcase 1 open; the arc shape also allows the first side 15 of the showcase 1 to be avoided better with the roto-translational movement.

The short rods 31 and the long rods 32 of the showcase 1 are sized so as to bear the weight of the openable panel in a distributed manner, distributed in a more or less balanced manner between the rods 31 and 32. Therefore, the rods 31 and 32 have a similar or the same section.

The operation of the showcase 1 is clear from its structure just described.

Figure 2:
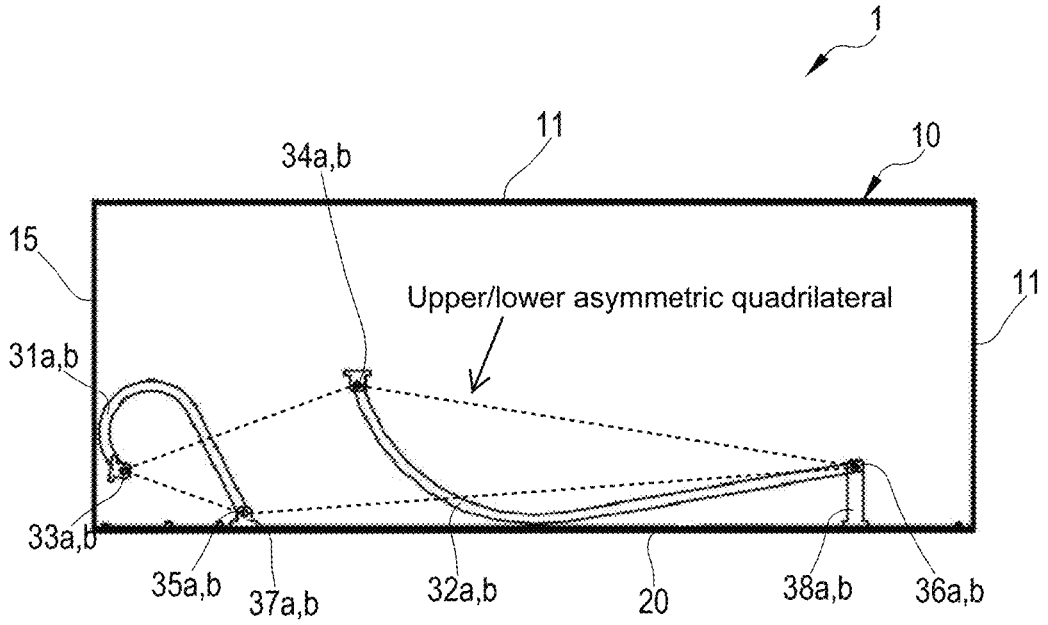
FIG. 2 is a schematic view from above of the showcase of FIG. 1, with openable panel in closure position.
Figure 3:
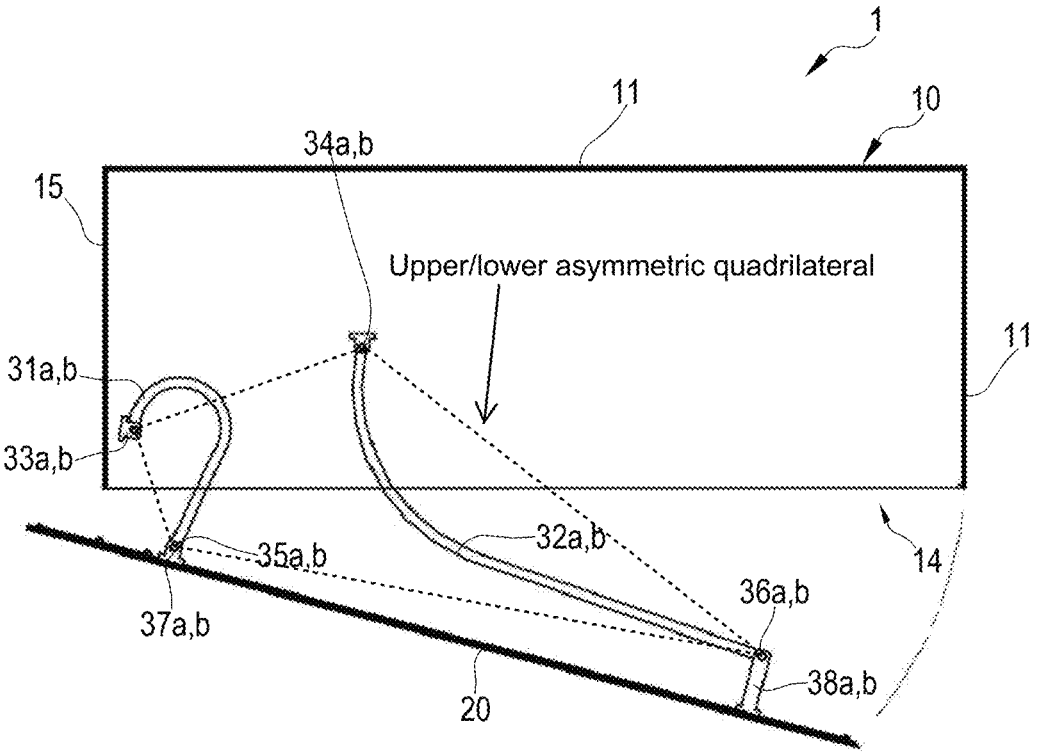
FIG. 3 is a schematic view from above of the showcase of FIG. 1, with openable panel in the step of passing from the closure position to the open position.
Figure 4:
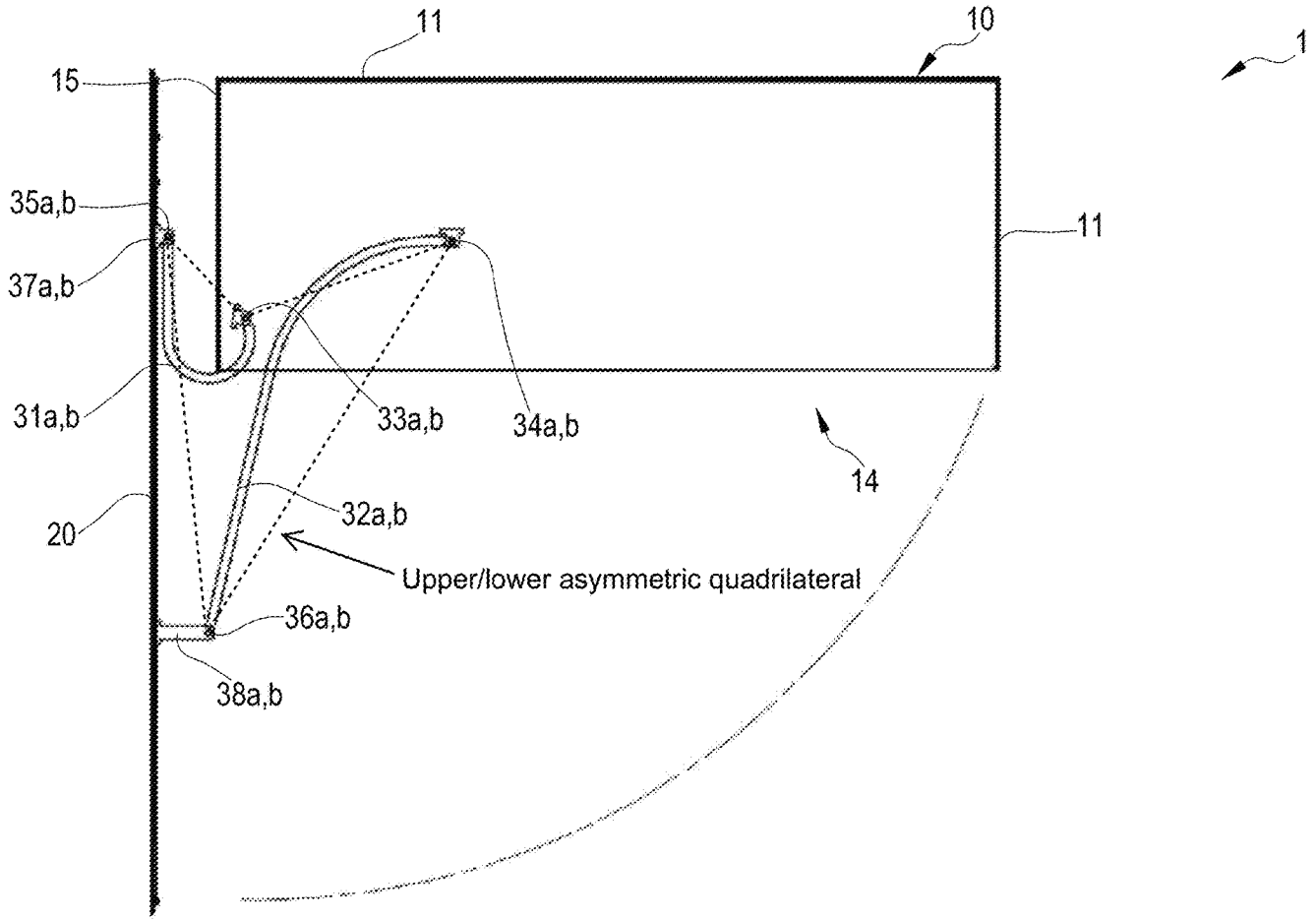
FIG. 4 is a schematic view from above of the showcase of FIG. 1, with openable panel in open position.
Figure 5:
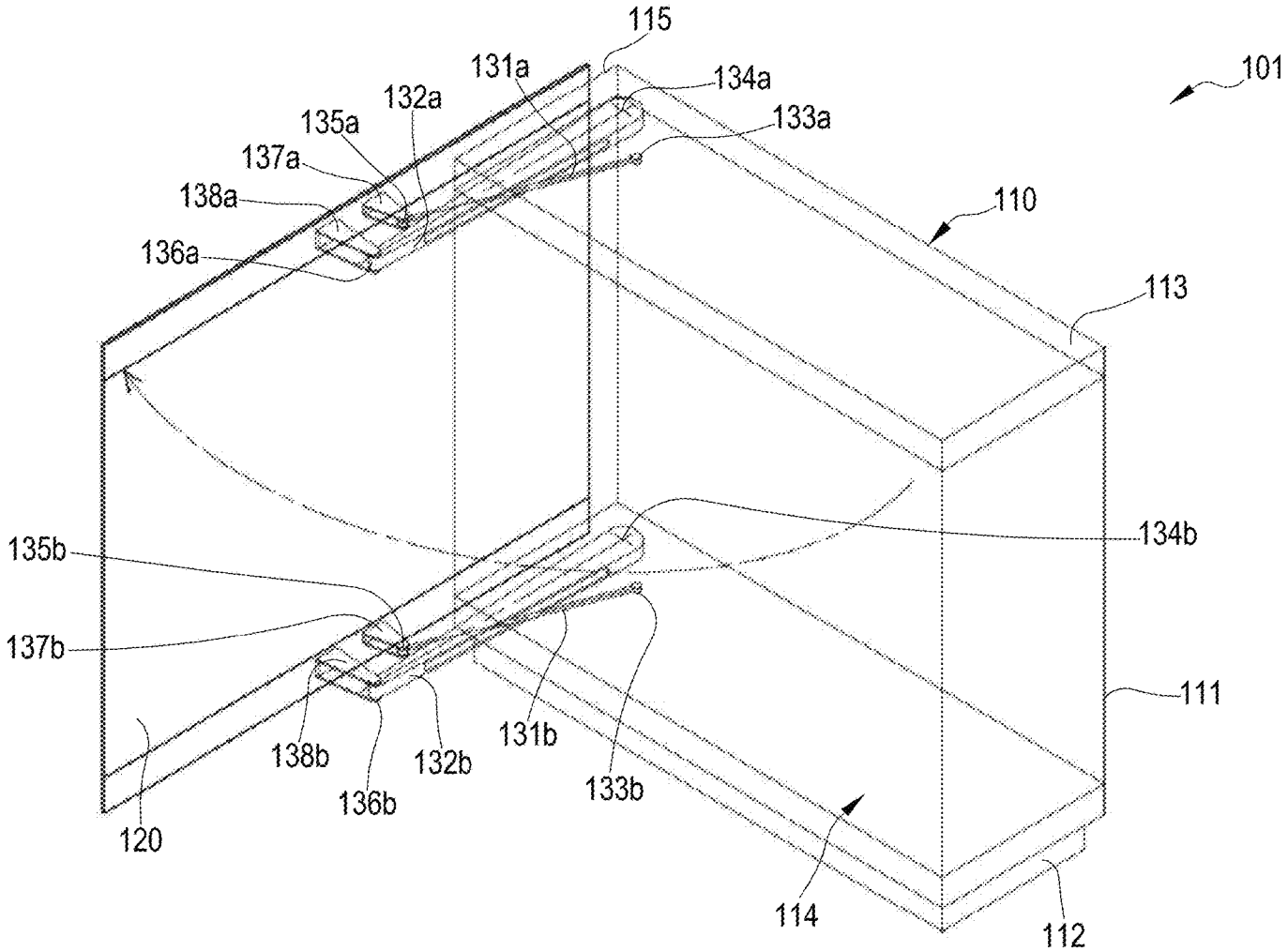
FIG. 5 is a schematic perspective view of a showcase according to a second embodiment of the invention, with openable panel in open position.
Figure 6:
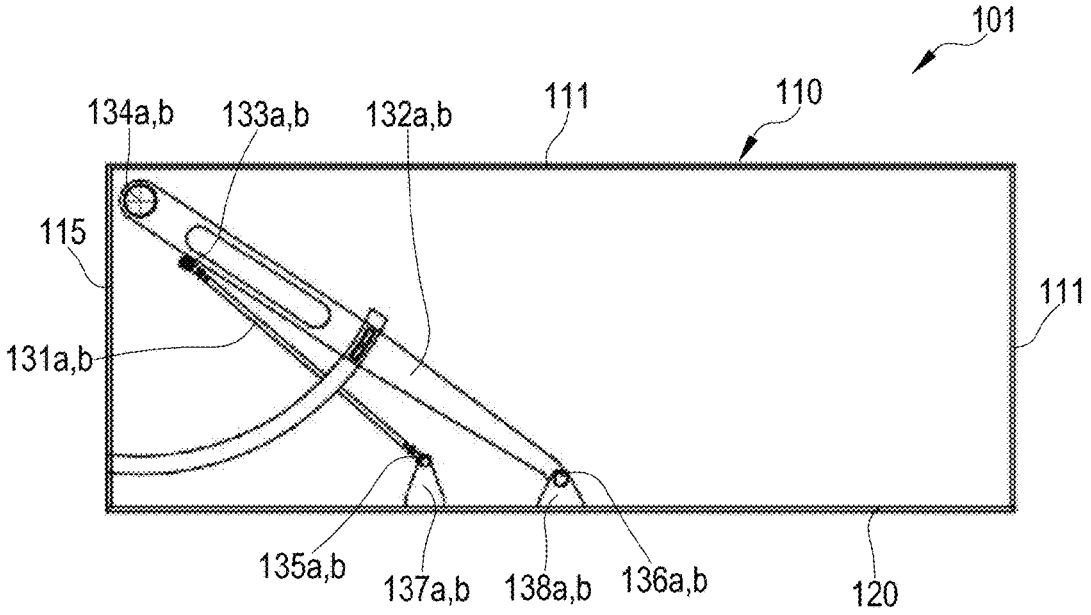
FIG. 6 is a schematic view from above of the showcase of FIG. 5, with openable panel in closure position.

The condition of the showcase 1 closed is shown in FIG. 2. In order to open the showcase 1, the rods 31, 32 are actuated simultaneously (manually or through motor means, in a per se known way). During opening, as shown in FIG. 3, the openable panel 20 is moved with roto-translational motion that makes it rotate and simultaneously translate around the edge of the fixed casing 10 that is located between the opening space 14 and the first side 15, until the completely open position illustrated in FIG. 4 is reached.

It should be noted how in completely open condition (FIG. 4) the openable panel is substantially adjacent to the outside of the first side 15 of the showcase 1, thus with minimal bulk. There is also minimal bulk during roto-translation, as shown by FIG. 3.

Figure 7:
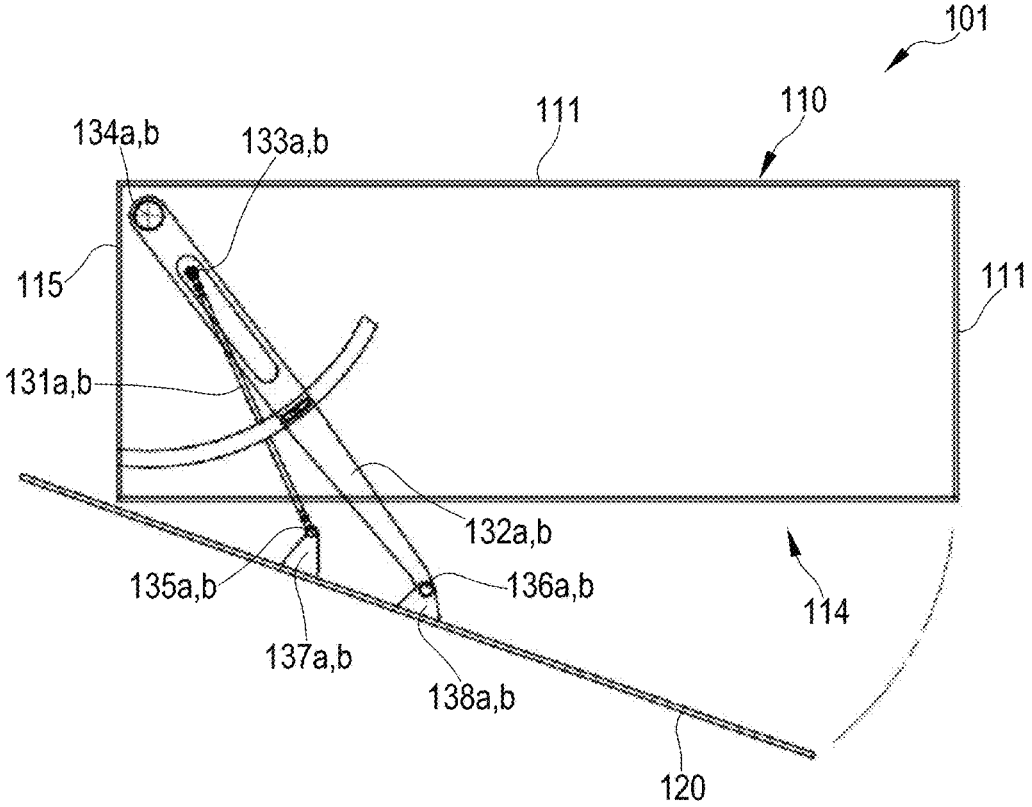
FIG. 7 is a schematic view from above of the showcase of FIG. 5, with openable panel in the step of passing from the closure position to the open position.
Figure 8:
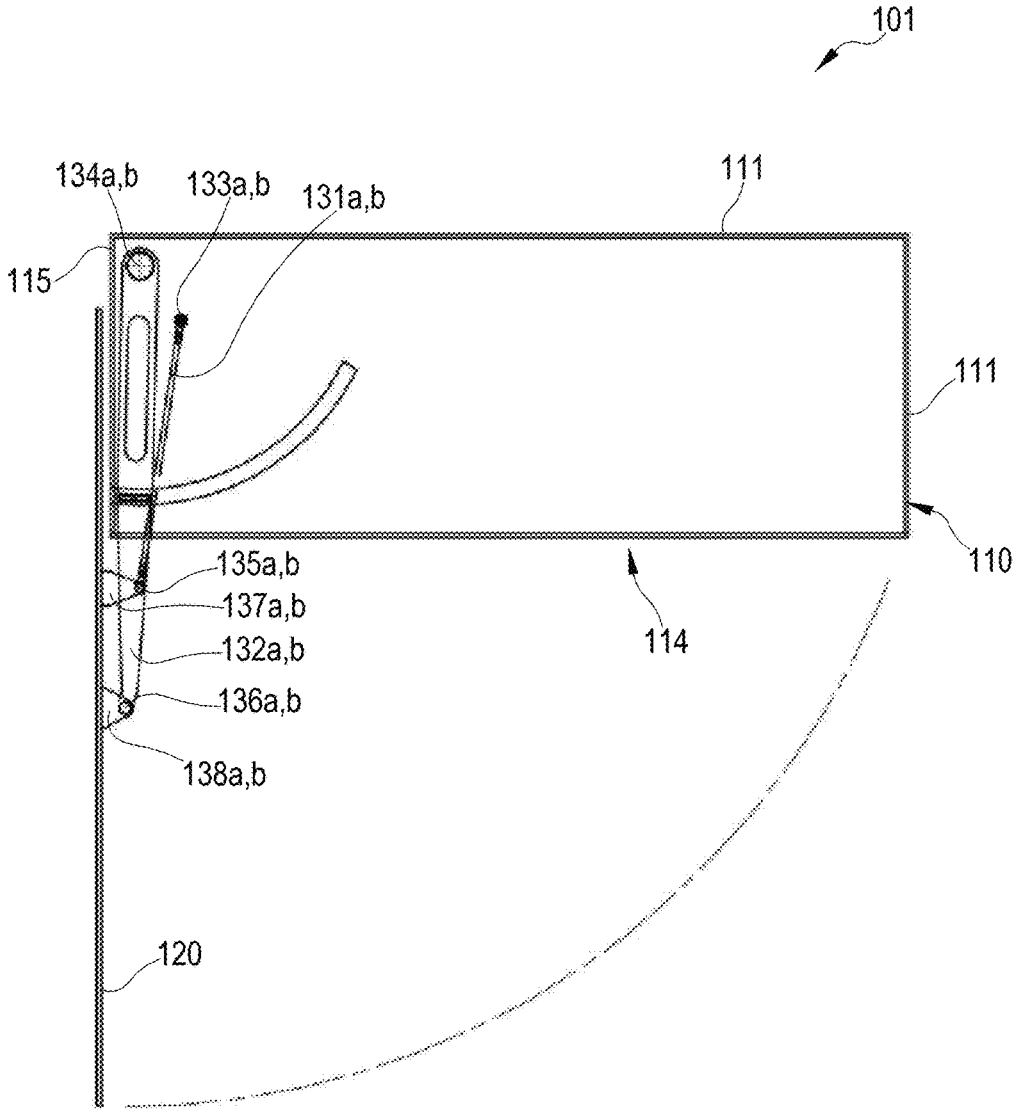
FIG. 8 is a schematic view from above of the showcase of FIG. 5, with openable panel in open position.
Figure 9:
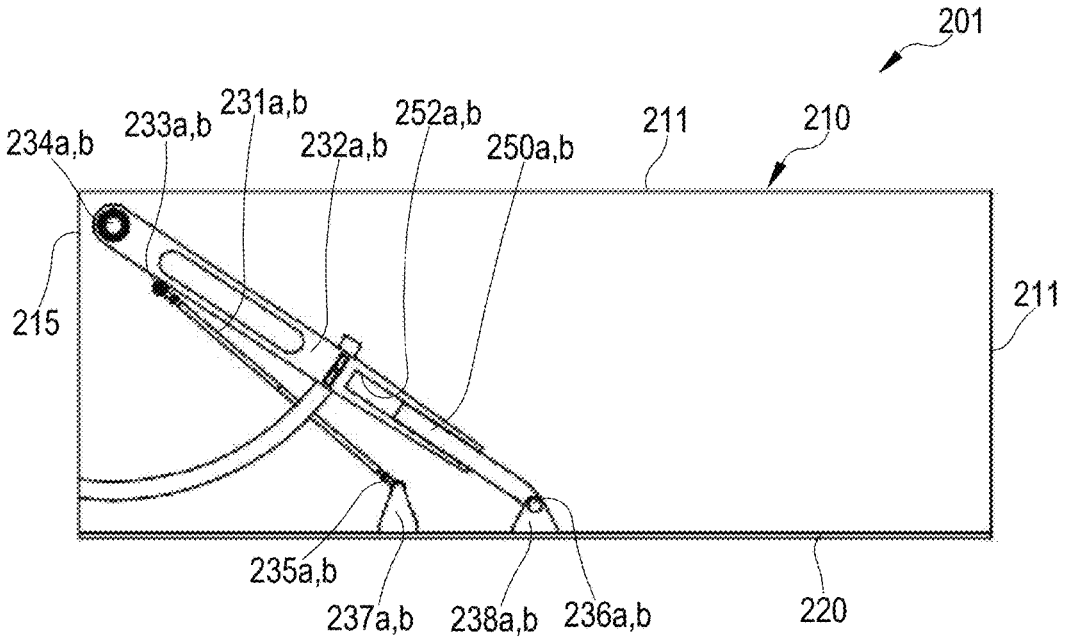
FIG. 9 is a schematic view from above of a showcase according to a third embodiment of the invention, with openable panel in closure position.
Figure 10:
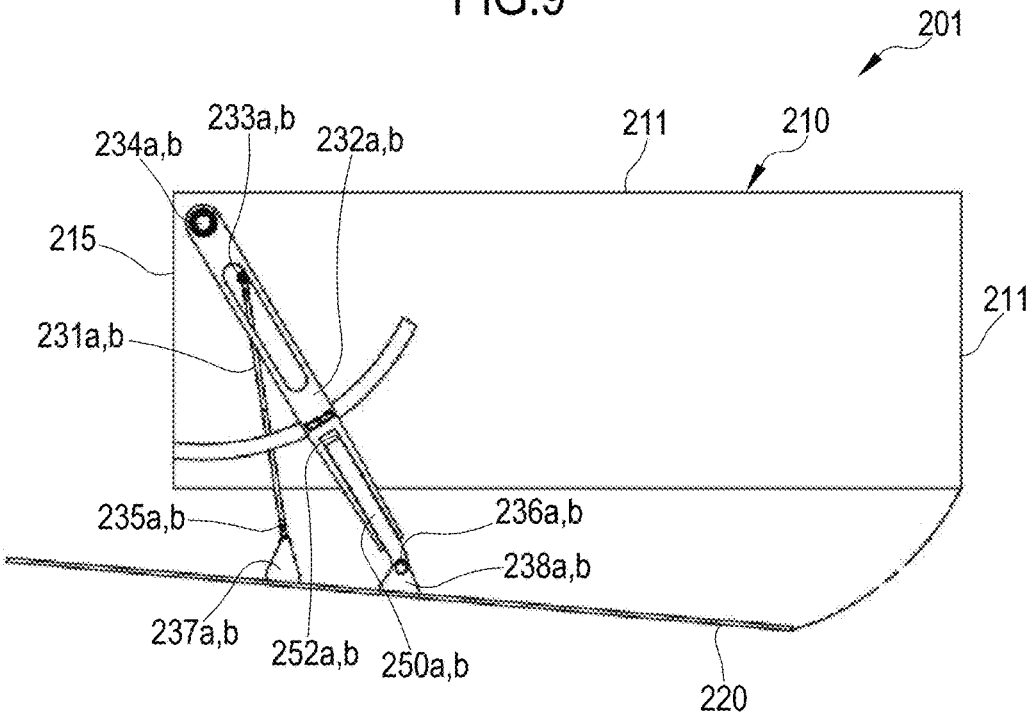
FIGS. 10 and 11 are schematic views from above of the showcase of FIG. 9, with openable panel in successive steps of passage from the closure position to the open position.
Figure 11:
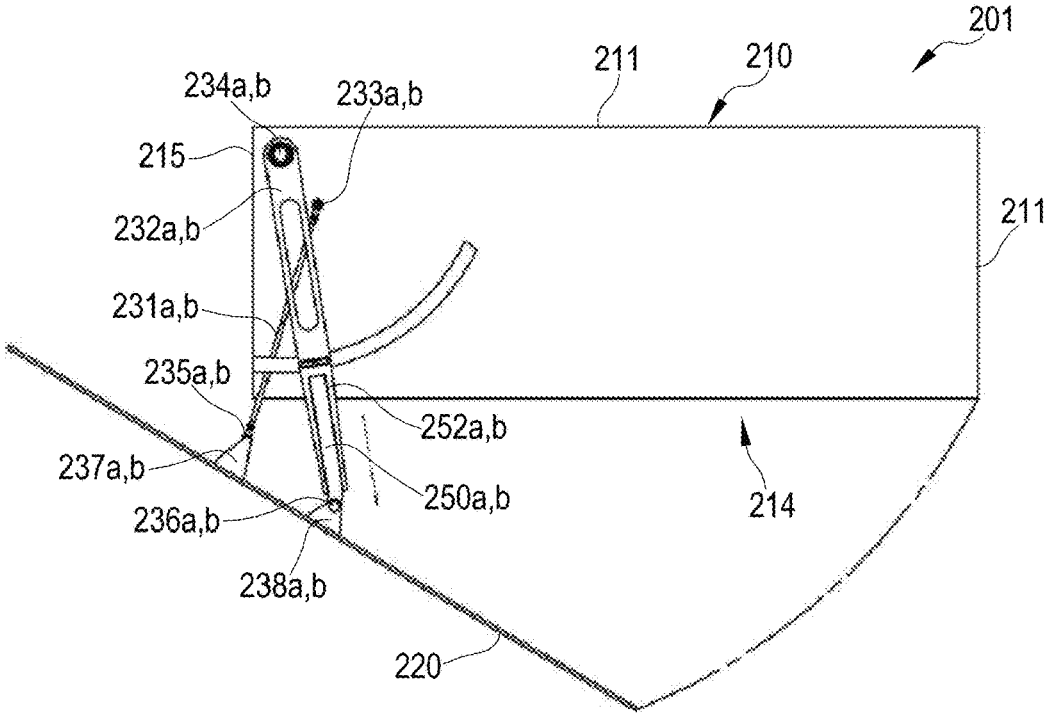
Figure 12:
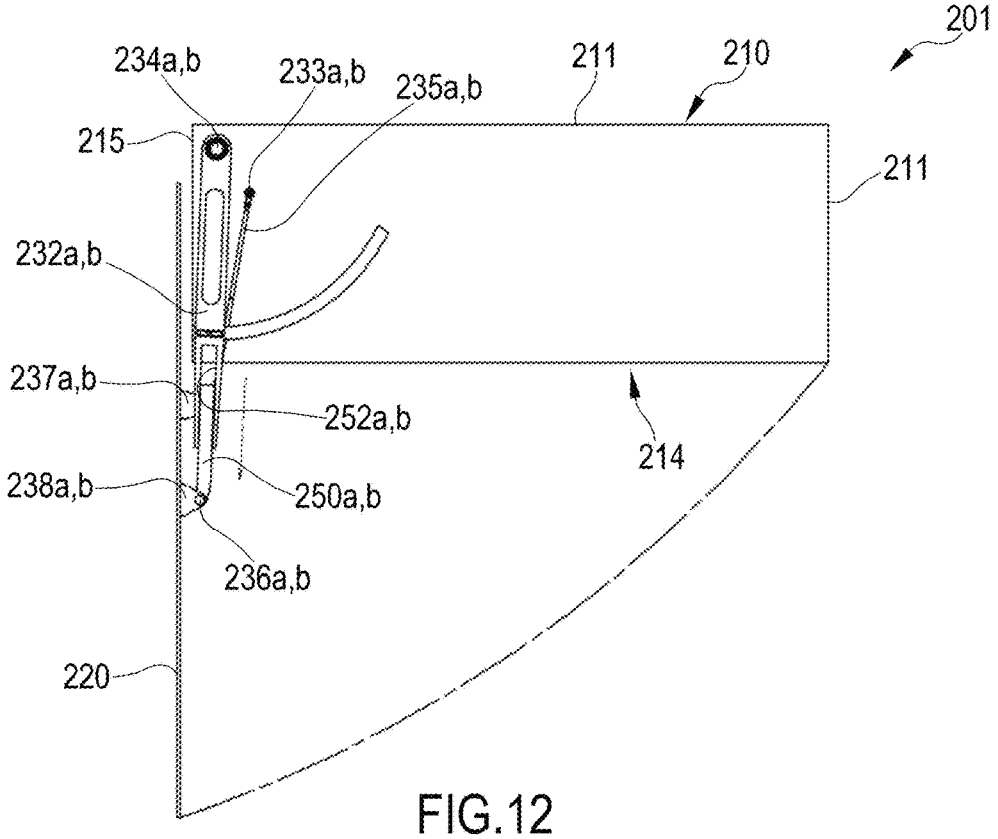
FIG. 12 is a schematic view from above of the showcase of FIG. 9, with openable panel in open position.

FIG. 5-8 shows a showcase 101 according to a different embodiment of the invention. The difference between the showcase 101 and the showcase 1 described earlier is limited to the shape of the rods: instead of the arc-shaped rods 31, 32, straight-shaped rods 131, 132 are provided. Moreover, the long rods 132 are sized to bear the entire weight of the openable panel 120 of the showcase 101, whereas the short rods 131 are much thinner, having only to guide the roto-translational movement. It is also worth noting (FIG. 7, compared with FIG. 3) the effect of the different geometry of the asymmetric quadrilaterals of the showcase 101: in the roto-translation, the openable panel

120 passes even closer to the fixed casing 110. All of the other characteristics are the same as those of the showcase 1 and will not be described; in the drawings, the elements of the showcase 101 that are the same as the elements of the showcase 1 are marked with the same reference numerals, increased by 100.

FIG. 9-12 shows a showcase 201 according to a different embodiment of the invention. The difference between the showcase 201 and the showcase 201 described earlier is limited to the long rods, which in the showcase 201 have a variable length; the long rods 232 indeed have a telescopic structure, in which the second long rod pins 236 are mounted on stems 250, in turn slidably guided in seats 252 formed in the long rods 232. This makes it possible to adjust the length of the rods 232 and thus introduce variations in the geometry of the quadrilaterals, variations that are useful in the step of installation and preparation of the showcase 201.

Moreover, this characteristic can be used to widen the opening of the showcase 201. As can be seen from the comparison of FIGS. 11 and 12, in the absence of adjustability of the length of the rods 232, the opening of the showcase 201 would be limited to the condition shown in FIG. 11, due to the interference between the rods 231 and the fixed casing 210; the completely open position shown in FIG. 12 can be reached by leaving the rods 232 free to lengthen.

The invention claimed is:

1. A showcase for preservation and display of objects, comprising a fixed casing and at least one openable panel made of glass, mounted through opening supports on the fixed casing so as to be openable externally at an opening space, towards a first side of the showcase, wherein:

the opening supports comprise an upper structure and a lower structure having a same geometry, respectively comprising a short upper rod and a long upper rod and a short lower rod and a long lower rod, wherein lengths of the short rods are equal to each other, and lengths of the long rods are equal to each other;

the short rods are pivoted to the fixed casing at respective first upper and lower aligned short rod pins and the long rods are pivoted to the fixed casing at respective first upper and lower aligned long rod pins;

the short rods are pivoted to the openable panel at respective second upper and lower aligned short rod pins and the long rods are pivoted to the openable panel at respective second upper and lower aligned long rod pins;

the upper short rod pins and the upper long rod pins being disposed so as to define an upper asymmetric quadrilateral shape;

the lower short rod pins and the lower long rod pins being disposed so as to define a lower asymmetric quadrilateral shape, the lower asymmetric quadrilateral shape being same as the upper asymmetric quadrilateral shape;

the short rods are arc-shaped short rods having, in a closed state of the showcase, a curvature facing towards the openable panel, so that the first side of the showcase positions inside the curvature when the showcase opens, thus allowing with the openable panel to avoid the first side of the fixed casing of the showcase when the openable panel is moved in a roto-translational movement; and the long rods are arc-shaped long rods having, in a closed state of the showcase, a curvature facing away from the openable panel so to limit the bulk of the long rods in front of the opening space of the showcase when the showcase opens.

2. The showcase according to claim 1, wherein with the showcase closed the second short rod pins are closer to the first side of the showcase with respect to the second long rod pins.

3. The showcase according to claim 1, wherein the first short rod pins are closer to the first side of the showcase with respect to the first long rod pins.

4. The showcase according to claim 1, wherein with the showcase closed the first short rod pins are closer to the openable panel with respect to the first long rod pins.

5. The showcase according to claim 1, wherein the short rods and the long rods are sized so as to bear the weight of the openable panel in a distributed manner.

6. The showcase according to claim 1, wherein:

a radius of the curvature of the short rods is centered on a side of the short rods facing away from the openable panel, and a radius of the curvature of the long rods is centered on a side of the long rods facing the openable panel.

7. The showcase according to claim 1, wherein the upper and lower rods are respectively mounted on an upper panel and a lower panel of the fixed casing.

8. A showcase for preservation and display of objects, comprising a fixed casing and at least one openable panel made of glass, mounted through opening supports on the fixed casing so as to be openable externally at an opening space, towards a first side of the showcase, wherein:

the opening supports comprise an upper structure and a lower structure having a same geometry, respectively comprising a short upper rod and a long upper rod and a short lower rod and a long lower rod, wherein lengths of the short rods are equal to each other, and lengths of the long rods are equal to each other;

the short rods are pivoted to the fixed casing at respective first upper and lower aligned short rod pins and the long rods are pivoted to the fixed casing at respective first upper and lower aligned long rod pins;

the short rods are pivoted to the openable panel at respective second upper and lower aligned short rod pins and the long rods are pivoted to the openable panel at respective second upper and lower aligned long rod pins;

the short rods are arc-shaped short rods having a curvature facing towards the openable panel, so that the first side of the showcase positions inside the curvature when the showcase opens, thus allowing with the openable panel to avoid the first side of the fixed casing of the showcase when the openable panel is moved in a roto-translational movement; and the long rods are arc-shaped long rods having a curvature facing away from the openable panel so to limit the bulk of the long rods in front of the opening space of the showcase when the showcase opens.

* * * * *